US007693474B2

(12) United States Patent
Kitano et al.

(10) Patent No.: US 7,693,474 B2
(45) Date of Patent: Apr. 6, 2010

(54) FIXING MEMBER WITH TONER RELEASING LAYER, AND FIXING APPARATUS WITH THE SAME

(75) Inventors: Yuji Kitano, Kawasaki (JP); Osamu Sotome, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 599 days.

(21) Appl. No.: 11/459,717

(22) Filed: Jul. 25, 2006

(65) Prior Publication Data

US 2007/0025741 A1 Feb. 1, 2007

(30) Foreign Application Priority Data

Jul. 29, 2005 (JP) ..... 2005-220624

(51) Int. Cl.
*G03G 15/20* (2006.01)

(52) U.S. Cl. ..... 399/333

(58) Field of Classification Search ..... 399/1, 399/333

See application file for complete search history.

(56) References Cited

U.S. PATENT DOCUMENTS

| | | | | |
|---|---|---|---|---|
| 6,321,062 | B1 * | 11/2001 | Kitano et al. | 399/333 |
| 2002/0098434 | A1 * | 7/2002 | Anno et al. | 430/108.8 |
| 2005/0214044 | A1 | 9/2005 | Sakakibara et al. | 399/333 |
| 2006/0008304 | A1 | 1/2006 | Kitano | 399/333 |

FOREIGN PATENT DOCUMENTS

| | | |
|---|---|---|
| JP | 2000-242115 | 9/2000 |
| JP | 2004-138956 | 5/2004 |

* cited by examiner

*Primary Examiner*—David M Gray
*Assistant Examiner*—Andrew V Do
(74) *Attorney, Agent, or Firm*—Fitzpatrick, Cella, Harper & Scinto

(57) ABSTRACT

A fixing member having a toner releasing layer superior in toner releasability and a fixing apparatus provided with the fixing member are provided. The toner releasing layer is composed of fluororubber having an ether linkage in its molecule and a polysiloxane-type surface-active agent having a polyether structure.

4 Claims, 3 Drawing Sheets

FIXING MEMBER WITH TONER RELEASING LAYER, AND FIXING APPARATUS WITH THE SAME

BACKGROUND OF THE INVENTION

1. Field of the Invention

The present invention relates to a fixing member used for a fixing apparatus in an electrophotographic image forming apparatus such as a copier or an LBP, and in particular, relates to a fixing member used preferably in a fixing apparatus of an oilless system. In addition, the present invention relates to a fixing apparatus using such a fixing member.

2. Description of the Related Art

A fixing member is required to have high toner releasability. If it has high toner releasability, when toner images formed electrostatically on a recording material, such as paper, is fixed with heat and pressure, it becomes hard for toner to adhere on a surface of the fixing member. When toner adheres to the member surface, that is, toner offset arises, a problem is raised in that image quality deteriorates due to chips arising partially in a toner image formed on a recording material, or offset toner being re-fixed to the following recording material. Hence, it has been investigated to use a material excellent in toner releasability on the surface of a fixing member, that is, for a releasing layer.

As such a fixing member, one is normally used in which a layer structure composed of one or more layers is formed on the outer periphery of a cylinder shaft, and a fluorocarbon resin is used for a releasing layer.

Although the fluorocarbon resin has low surface energy and is excellent in toner releasability, it has such a demerit that material hardness is high, because it is a resin. If hardness is high, when a toner image formed electrostatically is fixed with heat and pressure, an ability to follow unevenness of paper fibers is low, and hence, it becomes hard to obtain a high quality image. In addition, on a recording material which hardly has convexoconcave, it is difficult to obtain a high quality image because toner particles are crushed more than needed and a small character becomes illegible.

On the other hand, a member using a releasing layer constructed of an elastic material has flexibility in comparison with resins, and has such an advantage that it is easy to obtain a high quality image. Nevertheless, as compared with the fluorocarbon resin, an elastic material, that is, rubber, generally has high surface energy, and is apt to be inferior in toner releasability. In particular, only the fluorocarbon resin is put in practical use as a material used for a releasing layer in color oilless fixing, and a fixing member having a releasing layer constructed of rubber has not been put in practical use up to now. In order to obtain a high quality image, what is desired is not a releasing layer that is constructed of a hard resin, but a releasing layer which is constructed of a flexible rubber.

In addition, since a fixing member is used at a high temperature of about 200° C., a rubber used for a releasing layer is required to have heat resistance. Generally, as types of rubbers which have such heat resistance, fluororubber, silicone rubber, etc. may be cited. Fluororubber refers to a type of rubber, which is an elastic material, produced by adding a cross-linker, a cross-linking assistant, a reinforcing compounding agent and the like to a fluoropolymer which is constructed of partially fluorinated hydrocarbon chains, and forming a three-dimensional network through polyamine cross-linking, polyol cross-linking, or organic peroxide cross-linking.

Heretofore, fluororubber has been used mainly as a releasing layer in an oil coating system in which a denatured silicone oil is externally supplied in a color machine. Types of fluororubber polymers (fluoropolymers) are mainly used which are produced by polyamine-cross-linking or polyol-cross-linking a product produced by blending a metal-containing filler and a reinforcing bulking agent with a fluoropolymer which is constructed of a binary copolymer of vinylidene fluoride and hexafluoropropylene, or a terpolymer of vinylidene fluoride, hexafluoropropylene and tetrafluoroethylene.

Silicone rubber refers to a type of rubber, which is an elastic material, produced by forming a three-dimensional network through addition reaction cross-linking, organic peroxide cross-linking or the like of a product produced by blending various fillers as needed with a raw rubber such as polymers which are constructed of methyl-vinyl siloxane units or methyl-phenyl-vinyl siloxane units in which part of methyl groups of methyl-vinyl siloxane units have been replaced by phenyl groups.

Generally, silicone rubber has been primarily used as a thermally conductive elastic material lower layer because of excellent heat resistance. In addition, as a releasing layer, fluororubber has been mainly used in an oil coating system in which dimethylsilicone oil is externally supplied in a color machine.

However, an oilless fixing system with a fluorocarbon resin releasing layer has recently been put in practical use in which, in order to secure releasability, a wax having a releasing assistant effect is internally added to toner, and as mentioned above, no oil coating is externally carried out.

When fluororubber is used for a releasing layer instead of a fluorocarbon resin so as to obtain a high quality image, the affinity between wax in toner and fluororubber was low, and the releasing assistant effect of the wax is not fully exerted. Hence, paper winding arising when toner does not come off a releasing layer, or toner offset has occurred in some cases.

In addition, when dimethyl silicone rubber is used for a releasing layer, the affinity between wax in toner and dimethyl silicone rubber was high. But, the affinity is too high, and a certain adverse effect is exerted on toner releasability, and thus, paper winding or toner offset has occurred in some cases.

It is disclosed in Japanese Patent Application Laid-Open No. 2000-242115 to use a rubber releasing layer in color oilless fixing. The above-mentioned document discloses an image recording device in which a toner containing wax is used, and a releasing layer constructed of fluororubber high in affinity with the wax is formed on the fixing member surface on the side coming in contact with an unfixed toner image on a recording material in a fixing apparatus.

Although, in the above-mentioned document, the releasing layer constructed of fluororubber high in affinity with wax is proposed, this releasing layer is insufficient in toner releasability, and further improvement in toner releasability is desired.

In addition, Japanese Patent Application Laid-Open No. 2004-138956 proposes a fixing belt characterized in that a surface layer is constructed of a vulcanization product of a liquid coating composition having a ternary copolymer of tetrafluoroethylene, vinylidene fluoride and hexafluoropropylene, a vulcanizing agent, and silicone oil. It is described in this document that a silicone oil is preferable which is partly substituted with a fluoro alkyl group, or has at the end of its chemical structure a functional group selected from among a hydroxyl group, an alkoxy group, a carboxyl group and an alkoxy carbonyl group.

Although the above-mentioned document proposes the releasing layer which is constructed of a mixture of generalpurpose fluororubber and silicone oil, it has no mention concerning the dispersibility of fluororubber and silicone oil which are low in affinity with each other. If a sea-island structure is taken when the affinity between the two is low, the sizes of islands are uneven. In the case where a particularly large island occurs, a portion with insufficient toner releasability may arise.

SUMMARY OF THE INVENTION

An object of the present invention is to provide a fixing member having a releasing layer constructed of an elastic material which does not cause toner offset and is excellent in toner releasability. More specifically, the present invention is to provide a fixing member having a releasing layer in which the dispersibility of a silicone compound into a fluororubber is improved, and the silicone compound is finely dispersed in the fluororubber.

Another object of the present invention is to provide a fixing apparatus equipped with a fixing member which has such a releasing layer.

The above-mentioned objects of the present invention are achieved by the following invention.

The present invention relates to a fixing member used in an electrophotographic image forming apparatus, having a toner releasing layer formed on its surface, wherein the toner releasing layer contains as a main component a fluororubber having an ether linkage in its molecule, and further, contains at least a polysiloxane-type surface-active agent having at least a polyether structure.

DESCRIPTION OF THE EMBODIMENTS

As a means of suitably increasing the wax affinity of fluororubber, it is conceivable to disperse polysiloxane (for example, dimethylpolysiloxane) in the form of fine islands in the fluororubber. It is possible to increase the affinity of fluororubber with wax by dispersing polysiloxane high in affinity with wax into fluororubber low in affinity with wax.

However, If dimethylpolysiloxane is simply mixed with fluororubber, since the affinity between the two is low, the dispersion state is coarse and dispersed grain sizes become hundreds μm in many cases. Accordingly, in the present invention, the dispersibility of polysiloxane has been increased by using a fluororubber having an ether linkage in its molecule, and using as an additive a polysiloxane-type surface-active agent which has a polyether structure and good affinity with the fluoropolymer.

Figure 5:
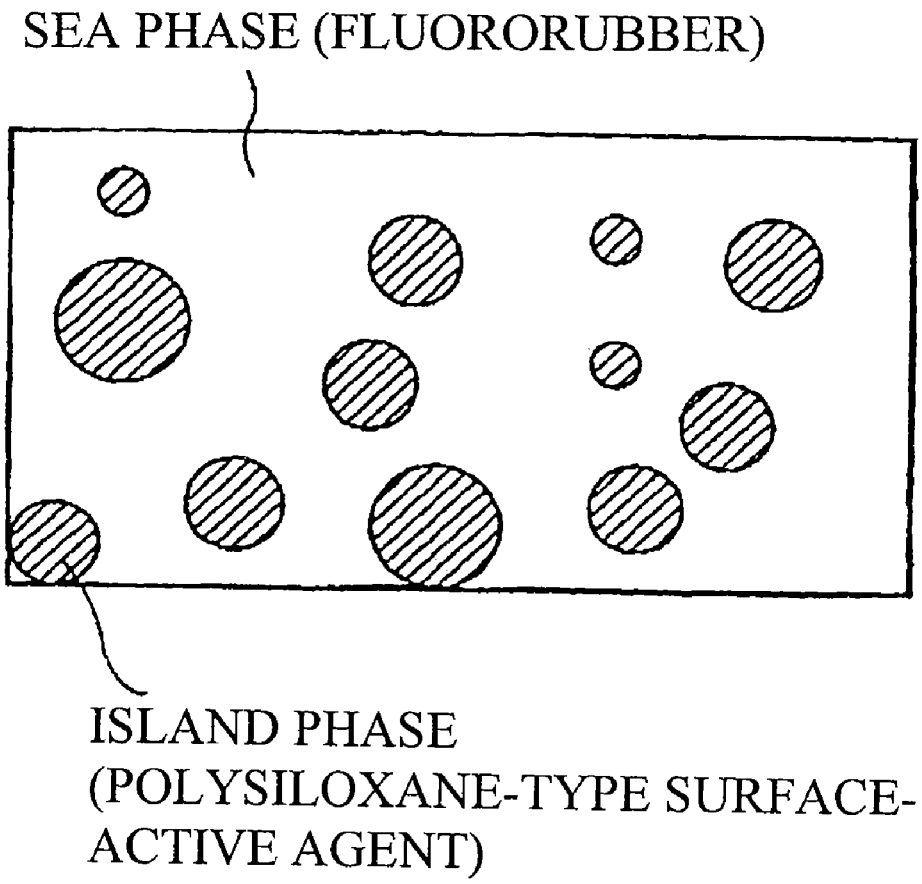
FIG. 5 is a drawing showing an example of a sea-island structure.

When dispersing the polysiloxane-type surface-active agent in fluororubber as mentioned above, it is preferable to perform the dispersion so as to create a sea-island structure in which the fluororubber constitutes the sea phase and the polysiloxane-type surface-active agent constitutes the island phases. An example of such a sea-island structure is shown in FIG. 5. In particular, it is preferable to perform the dispersion so that the number-based average size of the islands phases is 2 μm or less, and more preferably 0.1 μm or more. It is possible to evenly increase the releasability of toner from the surface of a fixing member by finely dispersing a polysiloxane-type surface-active agent in fluororubber.

The average sizes of the island phases can be measured by electron microscope observation. Twenty island phases are selected at random and the major axis of each of the island phases is measured. An average value of fourteen measured values which are obtained by removing three largest values and three smallest values from the measured values is regarded as the average size.

The polysiloxane-type surface-active agent is a nonionic surface-active agent which has preferably a dialkylpolysiloxane structure and more preferably a dimethylpolysiloxane structure as a hydrophobic group, and has preferably a polyether structure and more preferably a polyoxyalkylene structure as a hydrophilic group. Since the dialkyl polysiloxane-type surface-active agent has a siloxane skeleton, it is low in volatility and excellent in thermal stability, and hence, is suitable for a fixing member used at high temperature.

As mentioned above, fluororubber polymers (fluoropolymers) having been conventionally used include a binary copolymer of vinylidene fluoride and hexafluoropropylene, and a ternary copolymer of vinylidene fluoride, hexafluoropropylene, and tetrafluoroethylene. Nevertheless, taking into account the affinity with a polysiloxane-type surface-active agent having a polyether structure, it is preferable to use fluororubber which has an ether linkage. In particular, in the present invention, it is preferable to use as the fluororubber a ternary copolymer of vinylidene fluoride, tetrafluoroethylene and perfluoromethyl vinyl ether.

It is possible to classify the polysiloxane-type surface-active agent used in the present invention into three types of structures, taking dimethylpolysiloxane up as an example. That is, they are a side-chain modification type constructed of a structure in which polyoxyalkylene is bound to a side chain of a dimethylpolysiloxane skeleton represented by the following formula (1), a chain-end modification type which is constructed of a structure in which polyoxyalkylene is bound to the chain end of a dimethylpolysiloxane skeleton represented by the following formula (2), and a copolymerization type which is constructed of a structure in which dimethylpolysiloxane represented by the following formula (3), and polyoxyalkylene are alternately bound repeatedly. Among these, the copolymerization type represented by the formula (3) is more preferable because its dispersibility into fluororubber is most excellent.

(1)

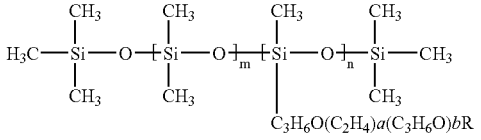

(2)

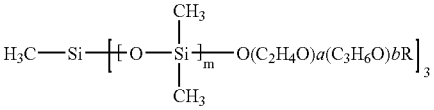

-continued

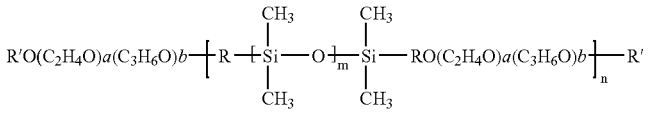

(3)

(In the formulas, a and b each denote 0 or an integer, n and m each denote an integer, and R and R' each denote a saturated hydrocarbon group or an unsaturated hydrocarbon group.)

It is preferable that the blending quantity of the polysiloxane-type surface-active agent is 20 to 60 parts by mass (more preferably, 40 to 60 parts by mass) with respect to 100 parts by mass of fluororubber. By using them within the above-described range, the effect of improving the toner releasability can be satisfactorily obtained, and it is possible to maintain the mechanical strength of fluororubber within a satisfactory range.

Although a cross-linker of fluororubber is not particularly limited, since it is applicable also to publicly known polymers with high fluorine contents and the durability of an elastomer obtained becomes high, it is preferable to use an organic peroxide cross-linker. Specifically, a polymer of fluororubber is of a type in which iodine or bromine is introduced into the chain end or side chain of its molecular chain, and the cross-linking by organic peroxide is performed by an abstraction reaction of iodine or bromine, and a radical reaction of a cross-linking assistant with the allyl group.

Although the cross-linking is performed by heating after forming a surface layer by solution coating, when the cross-linking is performed using organic peroxide, hardening may be inhibited by oxygen present in the air when atmospheric pressure hot air cross-linking such as oven cross-linking is performed. Hence, in order to cut off oxygen inhibiting hardening, it is preferable to perform cross-linking by means of an oven whose inside atmosphere has been replaced with nitrogen.

In view of surface energy, it is preferable that the rubber (fluororubber) in the releasing layer does not contain various fillers, for example, a reinforcing filler, or contains the fillers in an amount of five or less parts by mass with respect to 100 parts by mass of a mixture of the fluororubber and polysiloxane-type surface-active agent. If the releasing layer contains more than five parts by mass of fillers, the toner releasability may be lowered, which is not preferable.

The fixing member having a releasing layer constructed of fluororubber can be produced as follows, for example. Fifty parts by mass of polysiloxane-type surface-active agent having a polyether structure, 4 parts by mass of triallyl isocyanurate as a cross-linking assistant, and 3 parts by mass of benzoyl peroxide, which is organic peroxide, as a cross-linker with respect to 100 parts by mass of fluoropolymer containing iodine or bromine as a reaction group and an ether linkage in its molecule, are dissolved in a ketone-type solvent, sufficiently stirred, then applied by spray coating so as to form at least a surface layer of an elastic material layer formed on the outer periphery of a roller or a belt on which a primer has been uniformly applied and dried, and thereafter, pass through a primary cross-linking step in an oven whose inside atmosphere has been replaced with nitrogen and a secondary cross-linking step in a normal heating oven, thereby producing the fixing member.

Nevertheless, when a releasing layer is formed on thermally conductive silicone rubber, a cross-linker and a cross-linking assistant may migrate to the silicone rubber layer and their amounts in the releasing layer may decrease. Hence, it is preferable to beforehand blend the cross-linker and cross-linking assistant in amounts several times as much as the above-mentioned standard amounts. In addition, when a primer layer is formed on a thermally conductive silicone rubber layer, what is publicly known may be used as the primer layer, but it is preferable to use what can prevent a cross-linker and a cross-linking assistant from migrating. When using a publicly known primer, a thickness of the primer layer is not limited particularly, but it is usually about 1 to 5 μm.

Figure 1:
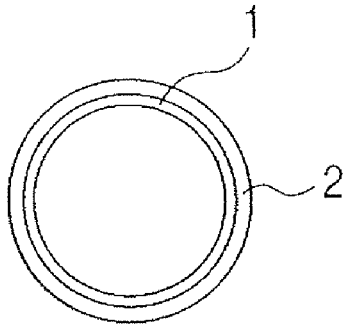
FIG. 1 is a sectional view of a fixing member with a single-layer structure.

FIG. 1 shows a cross-section of the fixing member having the single-layer structure thus obtained. It may be a belt-like member although FIG. 1 shows the structure of a roller. In FIG. 1, reference numeral 1 denotes a roller base material, and reference numeral 2 denotes a toner releasing layer which contains fluororubber having an ether linkage in its molecule and a polysiloxane-type surface-active agent having a polyether structure.

The thickness of a toner releasing layer may be determined suitably according to need, but, in order to secure sufficient flaw and wear resistance, it is preferable that in general, the thickness is 10 μm or more. In addition, it is desirable that in view of thermal conductivity, the thickness is 500 μm or less.

When used as a single-layer fixing belt with a toner releasing layer superimposed on a base material, it is preferable that the thickness of the toner releasing layer is 60 to 150 μm. If the thickness is brought into this range, it becomes possible to suppress a sharp decline in thermal efficiency while imparting elasticity to a belt surface.

In addition, the base material of a fixing belt is a seamless belt of 10 to 50 μm in thickness, and the material may be selected from among heat resistant resins such as polyimide and polyamidoimide, and metals such as SUS, nickel and aluminum. But, the material made of a metal having a small electric resistance value is preferable.

Figure 2:
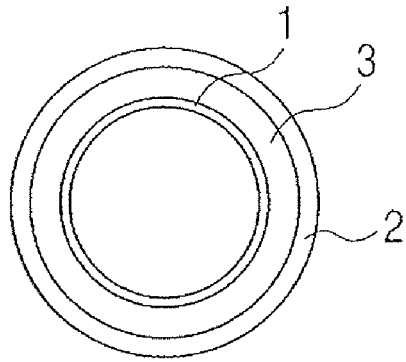
FIG. 2 is a sectional view of a fixing member with a two-layer structure.

A fixing member with a two-layer structure is shown in FIG. 2. It may be a belt-like member although FIG. 2 shows the structure of a roller. In the fixing member with a two-layer structure, first, a thermally conductive elastic material layer 3 constructed of conventional silicone rubber or the like is formed on the outer periphery of the roller base material 1, and a releasing layer 2 which contains fluororubber having an ether linkage in its molecule and a polysiloxane-type surface-active agent having a polyether structure is formed on the outer periphery of the thermally conductive elastic material layer 3.

As types of silicone rubbers used for a thermally conductive elastic material layer, polydimethylsiloxane, polymethylphenylsiloxane, etc. may be cited and it is preferable to use one of these materials blended with a thermally conductive filler. Such an elastic material layer may be formed by a publicly-known method such as a method in which a silicone rubber is injected into a molding die and heat-cured or a method in which a silicone polymer layer is formed through coating and cured by means of a heating oven.

It is preferable that the thickness of the thermally conductive elastic material layer is 50 μm or more in order to secure properties of following a recording material such as paper and is 5 mm or less in respect of the thermal conductivity.

Also in this case, the thickness of a releasing layer may be determined as in the case of a fixing member having a single-layer structure and the preferable range is 10 to 500 μm.

The fixing member of the present invention is not restricted to the above fixing member having a single-layer or two-layer structure and may have a multilayer structure composed of three layers or more, and besides, may be in the form of a fixing belt, a fixing roller, a pressure belt or a pressure roller.

It is preferable that the toner releasing layer is 10° to 60° in rubber hardness defined in JIS-A. In this case, images having higher quality can be obtained.

Next, a fixing apparatus of the present invention is described. The fixing apparatus of the present invention is used in an electrophotographic image forming apparatus and has a fixing member selected from the group consisting of a fixing roller, a fixing belt, a pressure roller and a pressure belt. The above fixing member is used as the fixing member. The electrophotographic image forming apparatus has, besides the fixing apparatus, a photosensitive member, a latent image forming means, a means for developing the formed latent image with toner and a means for transferring the developed toner image to a transfer material.

Figure 3:
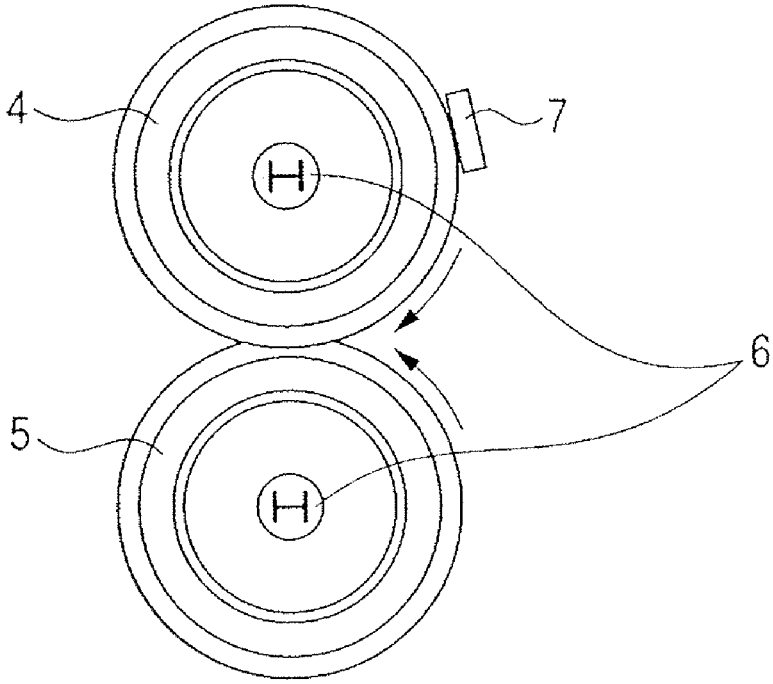
FIG. 3 is a schematic structural diagram of one form of a fixing apparatus.

FIG. 3 shows a structural diagram of a fixing apparatus of the present invention. A fixing roller 4 as a upper roller and a pressure roller 5 as a lower roller are set in the fixing apparatus. A fixing member of the present invention is used for the fixing roller 4 and pressure roller 5. A heater 6 constituted of a halogen lamp is installed in each of the center of the fixing roller 4 and the center of the pressure roller 5.

The fixing roller 4 is rotated in the direction of an arrow at a predetermined speed and the pressure roller 5 is also rotated in the direction of an arrow in accordance with the fixing roller 4. Then, a toner image formed on a recording material such as paper is fixed by heat from the heater 6 and the pressure applied between the fixing roller 4 and the pressure roller 5.

The fixing temperature is kept at a set temperature by controlling an output of the heater 6 in accordance with the surface temperature of the fixing roller 4 measured by a thermistor 7. Though the surface temperature (fixing temperature) of the fixing roller 4 is not particularly restricted, it normally ranges from 130° to 220° C.

A fixing apparatus using a upper roller and a lower roller is taken up herein as an example. However, a fixing apparatus of the present invention may have a fixing member of the present invention as a fixing belt, a fixing roller, a pressure belt or a pressure roller and is not restricted to the fixing apparatus shown in FIG. 3.

Next, a belt-heating-type fixing apparatus using a robber single-layer fixing belt is described with reference to FIG. 4.

Figure 4:
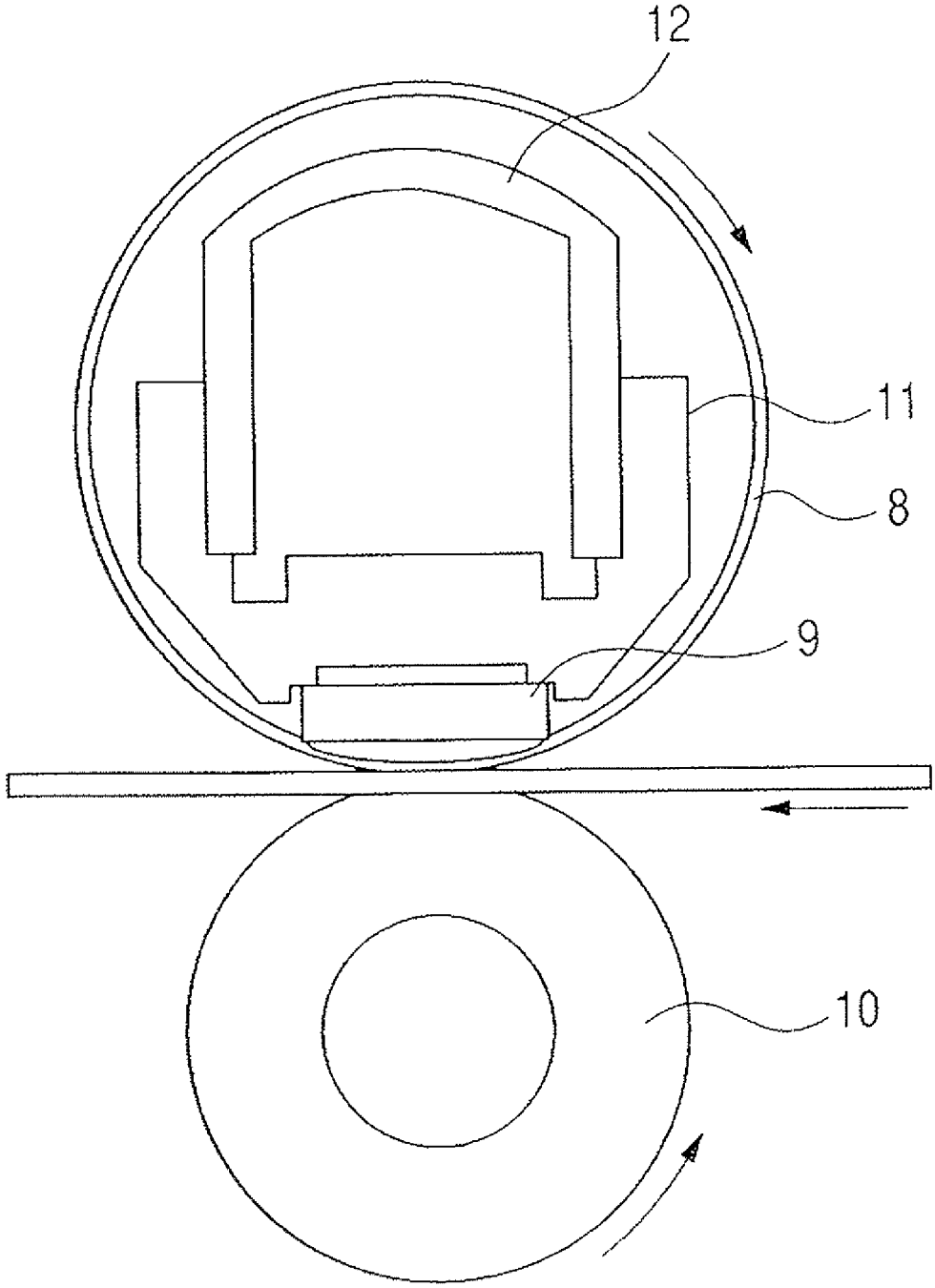
FIG. 4 is a schematic structural diagram of a belt-heating-type fixing apparatus.

In FIG. 4, reference numeral 8 denotes an endless-belt-like rubber single-layer fixing, reference numeral 11 denotes a belt guide portion, and reference numeral 12 denotes a stay. Reference numeral 9 denotes a heating member having a layer formed by applying an electric resistance material such as silver palladium (Ag/Pd) which generates heat by allowing an electric current to flow therethrough, on a heating substrate made of alumina or ceramic by screen printing in the form of lines or belts. Besides, a glass coating layer of about 10 μm in thickness is formed on the layer to protect the electric resistance material and to secure insulating properties. Furthermore, a thermistor is in contact with the back side of the heating substrate. Therefore, it is possible to keep the surface temperature of the rubber single-layer fixing belt at a temperature capable of fixing by controlling the power applied to the electric resistance material in accordance with the temperature detected by the thermistor.

Reference numeral 10 denotes a pressure roller which is one conformation of a pressure member. An elastic material layer made of silicone rubber having a thickness of 1 to 5 mm is formed on a mandrel made of aluminum, and on this elastic material layer, a releasing layer may be formed which is composed of a fluorocarbon resin such as PFA, FEP or PTFE having a thickness of 10 to 50 μm. The pressure roller is brought into pressure-contact with a heating body through a rubber single-layer fixing belt and rotated by a pressure roller driving means. The pressure roller 5 is rotated and the rubber single-layer fixing belt 8 is rotated following the rotation of the roller 5. A recording material such as paper with an unfixed image formed thereon is held and conveyed between the rubber single-layer fixing belt 8 and the pressure roller 10, whereby the unfixed image is heated and fixed to the recording material.

The present invention will be described below in detail by giving examples. However, the present invention is by no means limited to them.

EXAMPLES

Example 1

A weight of 100 g of fluoropolymer (trade name: DAIERU LT302 made by DAIKIN INDUSTRIES, LTD.) composed of a ternary copolymer of vinylidene fluoride containing iodine as a reactive radical in its molecule, tetrafluoroethylene and perfluoromethyl vinyl ether, 40 g of a copolymerization type of polysiloxane-type surface-active agent having a structure in which dimethylpolysiloxane and polyoxialkylene had been alternately repetitively combined (trade name: FZ-2207 made by TORAY Dow Corning Co., Ltd.), 4 g of triallyl isocyanurate (trade name: TAIC made by Nippon Kasei Chemical Co., Ltd.) as a cross-linking assistant and 4 g of benzoyl peroxide (an organic peroxide) as a cross-linking agent (water content: 25%; made by KISHIDA KAGAKU Co., Ltd.) were dissolved in 900 g of methyl isobutyl ketone (a ketone-type solvent), to thereby prepare a coating solution.

A thermally conductive elastic material layer made of silicone rubber having a thickness of 1.5 mm was formed on the surface of a roller having an outside diameter of 35 mm and a primer (trade name: MEGUM3290 made by Chemetall Inc.) was uniformly applied on the surface of the layer to have a thickness of 2 μm and dried. The coating solution prepared above was sufficiently stirred and applied by spray-coating on the outer periphery of the roller to have a thickness of 30 μm after dyed. Then, the coated roller was heated in an oven whose inside atmosphere had been replaced with nitrogen at 200° C., thereby performing primary cross-linking, and secondary cross-linking was carried out (at 180° for 24 hr) in a normal oven. Thus, a fixing member in which a releasing layer was superimposed on the thermally conductive elastic material layer was produced.

In addition, a sample for analyzing the releasing layer was prepared to examine the dispersive conformation of the polysiloxane-type surface-active agent in the cross section of the sample. As a result, it was found that the sample had a sea-island structure in which the fluororubber constituted a sea phase and the polysiloxane-type surface-active agent constituted island phases and the number-based average size of the island phases was 0.8 μm.

In addition, a fluororubber layer 10 mm in thickness having the same formulation as the releasing layer was formed on a flat plate, and the rubber harness of the fluororubber layer thus formed was measured. As a result, the rubber hardness was 32°.

The fixing member produced by the above method is set in a fixing apparatus having the configuration shown in FIG. 3 as the fixing roller 4. Transfer sheets holding unfixed images formed from a wax-containing toner were fed to the fixing apparatus. The unfixed images of the wax-contained toner were formed by using a color printer LBP-5900 manufactured by CANON INC. from which a fixing apparatus had been removed. The transfer sheets holding the unfixed images were fed under the condition that the surface temperature on the fixing side of the fixing means was set at 180° C. and a process speed was 90 mm/sec., and such an evaluation as described later was made.

Example 2

A fixing member was produced in the same manner as in Example 1 except that the blending quantity of the copolymerization type of polysiloxane-type surface-active agent (trade name: FZ-2207 made by TORAY Dow Corning Co., Ltd.) was changed to 20 g. Transfer sheets holding unfixed images formed from a wax-containing toner were fed in the same manner as in Example 1 except that the fixing member was used as the fixing roller 4, and the same evaluation as in Example 1 was made.

In addition, a sample for analyzing the releasing layer was prepared to examine the dispersive conformation of the polysiloxane-type surface-active agent in the cross section of the sample. As a result, it was found that the sample had a sea-island structure in which the fluororubber constituted a sea phase and the polysiloxane-type surface-active agent constituted island phases and the number-based average size of the island phases was 0.7 μm.

The rubber hardness of the releasing layer was measured in the same manner as in Example 1, and found to be 40°.

Example 3

A fixing member was produced in the same manner as in Example 1 except that the blending quantity of the copolymerization type of polysiloxane-type surface-active agent (trade name: FZ-2207 made by TORAY Dow Corning Co., Ltd.) was changed to 60 g. Transfer sheets holding unfixed images formed from a wax-containing toner were fed in the same manner as in Example 1 except that the fixing member was used as the fixing roller 4, and the same evaluation as in Example 1 was made.

In addition, a sample for analyzing the releasing layer was prepared to examine the dispersive conformation of the polysiloxane-type surface-active agent in the cross section of the sample. As a result, it was found that the sample had a sea-island structure in which the fluororubber constituted a sea phase and the polysiloxane-type surface-active agent constituted island phases and the number-based average size of the island phases was 0.9 μm.

The rubber hardness of the releasing layer was measured in the same manner as in Example 1, and found to be 29°.

Example 4

A fixing member was produced in the same manner as in Example 1 except that the polysiloxane-type surface-active agent was changed to a side-chain modification type constituted of a structure in which polyoxyalkylene was combined with a side-chain of a dimethlypolysiloxane skeleton (trade name: FZ-5609 made by TORAY Dow Corning Co., Ltd.).

Transfer sheets holding unfixed images formed from a wax-containing toner was fed in the same manner as in Example 1 except that the fixing member was used as the fixing roller 4, and the same evaluation as in Example 1 was made.

In addition, a sample for analyzing the releasing layer was prepared to examine the dispersive conformation in the cross section of the sample. As a result, it was found that the sample had a sea-island structure in which the fluororubber constituted a sea phase and the polysiloxane-type surface-active agent constituted island phases and the number-based average size of the island phases was 2 μm.

The rubber hardness of the releasing layer was measured in the same manner as in Example 1, and found to be 33°.

Example 5

A fixing member was produced in the same manner as in Example 1 except that the polysiloxane-type surface-active agent was changed to a chain-end modification type (trade name: L-720 made by TORAY Dow Corning Co., Ltd.) constituted of a structure in which polyoxyalkylene was combined with the chain end of a dimethlypolysiloxane skeleton (trade name: L-720 made by TORAY Dow Corning Co., Ltd.).

Transfer sheets holding unfixed images formed from a wax-containing toner were fed in the same manner as in Example 1 except that the fixing member was used as the fixing roller 4, and the same evaluation as in Example 1 was made.

In addition, a sample for analyzing the releasing layer was prepared to examine the dispersive conformation of the polysiloxane-type surface-active agent in the cross section of the sample. As a result, it was found that the sample had a sea-island structure in which the fluororubber constituted a sea phase and the polysiloxane-type surface-active agent constituted island phases and the number-based average size of the island phases was 2 μm.

The rubber hardness of the releasing layer was measured in the same manner as in Example 1, and found to be 33°.

Comparative Example 1

A fixing member was produced in the same manner as in Example 1 except that the fluoropolymer used in Example 1 was changed to fluoropolymer (trade name: DAIERU G902 made by DAIKIN INDUSTRIES, LTD.) composed of a ternary copolymer of vinylidene fluoride containing iodine as a reactive group in its molecule, hexafluoropropylene and tetrafluoroethylene.

Transfer sheets holding unfixed images formed from a wax-contained toner were fed in the same manner as in Example 1 except that the fixing member produced by the above method was used as the fixing roller 4, and the same evaluation as in Example 1 was made.

In addition, a sample for analyzing the releasing layer was prepared to examine the dispersive conformation of the polysiloxane-type surface-active agent in the surface and the cross section of the sample. As a result, the cross section of the sample had a sea-island structure in which the fluororubber constituted a sea phase and the polysiloxane-type surface-active agent constituted island phases, but only the fluororubber was present on the surface and the number-based average size of the island phases in the cross section was 30 μm.

The rubber hardness of the releasing layer was measured in the same manner as in Example 1, and found to be 34°.

Comparative Example 2

A fixing member was produced in the same manner as in Example 1 except that dimethylpolysiloxane was blended instead of the polysiloxane-type surface-active agent and the bending quantity of benzoyl peroxide serving as a cross-linking agent was changed to 5.6 g.

Transfer sheets holding unfixed images formed from a wax-containing toner were fed in the same manner as in Example 1 except that the fixing member prepared by the above method was used as the fixing roller 4, and the same evaluation as in Example 1 was made.

In addition, a sample for analyzing the releasing layer was prepared to examine the dispersive conformation of the polysiloxane-type surface-active agent in the surface and the cross section of the sample. As a result, it was found that the cross section had a sea-island structure in which the fluororubber constituted a sea phase and the dimethylpolysiloxane constituted island phases, but only the fluororubber was present on the surface and the number-based average size of the island phases in the cross section was 50 μm.

The rubber hardness of the releasing layer was measured in the same manner as in Example 1, and found to be 34°.

Table 1 shows the formulations and evaluation results in Examples 1 to 5 and Comparative Examples 1 and 2.

In Examples 1 and 3, the fixing rollers were used having a releasing layer in which a ternary copolymer of vinylidenefluoride having an ether linkage in its molecule, tetrafluoroethylene and perfluoromethyl vinyl ether was used as a type of fluororubber polymer and a copolymerization type of polysiloxane-type surface active agent having a polyether structure was blended. As a result of feeding transfer sheets holding unfixed images formed from a wax-containing toner, the toner releasability was good, and even at the time 30,000 sheets had been fed, a blank area created by offset was not observed on the fixed images and high quality toner images were obtained.

In Example 2 in which the blending quantity of the polysiloxane-type surface-active agent is 20 parts by weight, as a result of feeding transfer sheets holding unfixed images formed from a wax-containing toner, the toner releasability was is good. At the time 20,000 sheets had been fed, an blank area created by offset was not observed on fixed images and high-quality toner images were obtained.

In Example 4, the polysiloxane-type surface-active agent used in Example 1 was changed to a side chain modification type of polysiloxane-type surface-active agent having a polyether structure, and in Example 5, to a chain-end modification type of polysiloxane-type surface-active agent having a polyether structure. In the evaluation made by using the fixing rollers produced in Examples 4 and 5, the toner releasability was good, and at the time 20,000 sheets had been fed, a blank area created by offset was not observed on fixed images and high-quality toner images were obtained.

TABLE 1

| | Type of fluororubber polymer | Type of compounding agent | Blending quantity (parts by mass) | Dispersive conformation of polysiloxane-type surface-active agent | Rubber hardness of releasing layer (°) | toner releasability |
|---|---|---|---|---|---|---|
| Ex. 1 | VDF-TFE-PMVE | Copolymerization type of polysiloxane-ype surface-active agent | 40 | Island phase of 0.8 μm | 32 | A |
| Ex. 2 | VDF-TFE-PMVE | Copolymerization type of polysiloxane-type surface-active agent | 20 | Island phase of 0.7 μm | 40 | A |
| Ex. 3 | VDF-TFE-PMVE | Copolymerization type of polysiloxane-type surface-active agent | 60 | Island phase of 0.9 μm | 29 | A |
| Ex. 4 | VDF-TFE-PMVE | Side-chain modification type of polysiloxane-type surface-active agent | 40 | Island phase of 2 μm | 33 | B |
| Ex. 5 | VDF-TFE-PMVE | Chain-end modification type of polysiloxane-type surface-active agent | 40 | Island phase of 2 μm | 33 | B |
| Com. Ex. 1 | VDF-HFP-TFE | Copolymerization type of polysiloxane-type surface-active agent | 40 | Island phase of 30 μm | 34 | D |
| Com. Ex. 2 | VDF-TFE-PMVE | Dimethyl-polysiloxane | 40 | Island phase of 50 μm | 34 | C |

Type of fluororubber polymer
VDF: Vinylidenefluoride,
HFP: Hexafluoropropylene
TFE: Tetrafluoroethylene,
PMVE: Perfluoromethyl vinyl ether Toner releasability was evaluated in accordance with the following references.

A: Offset does not occur after feeding 30,000 sheets.

B: Offset does not occur after feeding 20,000 sheets.

C: Offset occurs at the 100-th sheet.

D: Offset occurs from the first sheet.

In Comparative Example 1, a copolymerization type of polysiloxane-type surface-active agent having a polyether structure was blended, but a ternary copolymer of vinylidene fluoride having no ether linkage in its molecule, hexafluoropropylene and tetrafluoroethylene was used as a type of fluororubber polymer. In this case, the dispersive conformation of the polysiloxane surface-active agent was rough. As a result of feeding transfer sheets holding unfixed images formed from a wax-containing toner, the toner releasability was insufficient, and at the time the first sheet was fed, a blank area created by offset occurred on fixed images and the fixing performance was unsatisfactory.

In Comparative Example 2, fluorine rubber having an ether linkage in its molecule was used, but dimethylpolysiloxane having no alkylene oxide was blended. In this case, the dispersive conformation of the polysiloxane-type surface-active agent was rough. As a result of feeding transfer sheets holding unfixed images formed from a wax-containing toner, and the toner releasability was insufficient, and at the time the 100-th sheet was fed, offset occurred and the fixing performance was unsatisfactory.

Example 6

A weight of 100 g of fluoropolymer composed of a ternary copolymer of vinylidene fluoride having iodine as a reactive group in its molecule, tetrafluoroethylene and perfluoromethyl vinyl ether (trade name: DAIERU LT302 made by DAIKIN INDUSTRIES, LTD.), 50 g of a copolymerization type of polysiloxane-type surface-active agent having a structure in which dimethylpolysiloxane and polyoxialkylene had alternately repeatedly been combined (trade name: FZ-2207 made by TORAY Dow Corning Co., Ltd.), 4 g of triallyl isocyanurate (trade name: TAIC made by Nippon Kasei Chemical Co., Ltd.) as a cross-linking assistant and 4 g of benzoyl peroxide (an organic peroxide) as a cross-linking agent (water content: 25%, made by KISHIDA KAGAKU Co., Ltd.) were dissolved in 900 g of methyl isobutyl ketone (a ketone-type solvent), thereby preparing a coating solution.

A primer (trade name: MEGUM3290 made by Chemetall Inc.) was uniformly applied on the surface of a belt base material (made of SUS; outside diameter: 30 mm; thickness: 30 μm) and dried. The coating solution prepared above was applied by spray-coating on the outer periphery of the belt to have a thickness of 100 μm. Then, the coated roller was heated in an oven whose inside atmosphere had been replaced with nitrogen at 130° C. for 1 hr, thereby performing primary cross-linking, and secondary cross-linking was carried out in a normal oven at 180° C. for 24 hr. Thus, a single-layer fixing belt having a releasing layer on the base material was produced.

The single-layer fixing belt produced by the above method was set in a belt-heating-type fixing apparatus having the structure shown in FIG. 4 as the fixing belt 8. Transfer sheets holding unfixed images formed from a wax-containing toner was fed to the fixing apparatus. The unfixed full-color images of the wax-containing toner were formed by using a color printer LBP-5900 made by CANON INC. from which a fixing apparatus had been removed. The transfer sheets holding the unfixed images were fed under the condition that the surface of the single-layer fixing belt was set at 180° C. and a process speed was 90 mm/sec, and the fixed images were visually evaluated.

In addition, the electric resistance value in the cross-sectional direction of the rubber single-layer fixing belt was measured. In the case of the electric resistance value was a value measured when applying a voltage of 400 V at an area of 11.9 $cm^2$ in the belt cross-sectional direction. The electric resistance value thus measured was $1\times10^9\Omega$.

The heat transfer properties of the rubber single-layer fixing belt was evaluated according to the paper-surface ultimate temperature reached when a sheet of paper with a thermocouple attached thereto was fed in the steady state in which the surface temperature of the rubber single-layer fixing belt was 180° C. The temperature thus measured was 142° C.

Furthermore, the rubber hardness of the releasing layer similarly was measured in the same manner as in Example 1, and found to be 30°.

Example 7

A single-layer fixing belt was produced in the same manner as in Example 6 except that the thickness of the releasing layer (rubber layer) was set to 60 μm. Transfer sheets holding unfixed full-color images formed from a wax-containing toner were fed in the same manner as in Example 6 except that the single-layer fixing belt prepared by the above method was used as the fixing belt 8, and the fixed images were visually evaluated.

The electric resistance value in the cross-sectional direction of the rubber single-layer fixing belt was measured in the same manner as in Example 6, and found to be $5\times10^8\Omega$.

In addition, the paper-surface ultimate temperature was measured in the same manner as in Example 6, and found to be 148° C.

Furthermore, the rubber hardness of the mold release layer was measured in the same manner as in Example 1, and found to be 30°.

Example 8

A single-layer fixing belt was produced in the same manner as in Example 6 except that the thickness of the release layer (rubber layer) was set to 150 μm. Transfer sheets holding unfixed full-color image formed from a wax-containing toner were fed in the same manner as in Example 6 except that the single-layer fixing belt prepared by the above method was used as the fixing belt 8, and the fixed images were visually evaluated.

The electric resistance value in the cross-sectional direction of the above rubber single-layer fixing belt was measured in the same manner as in Example 6, and found to be $2\times10^9\Omega$.

In addition, the paper-surface ultimate temperature was measured in the same manner as in Example 6, and found to be 135° C.

Furthermore, the rubber hardness of the releasing layer was measured in the same manner as in Example 1, and found to be 30°.

Table 2 shows the formulations and evaluation results in Examples 6 to 8. The evaluation references of toner releasability were the same as the evaluation references in Example 1.

TABLE 2

| | Type of Fluororubber polymer | Type of compounding agent | Blending quantity (parts by mass) | Dispersive conformation of polysiloxane surface-active agent | Rubber hardness of releasing layer (°) | Toner releasability |
|---|---|---|---|---|---|---|
| Ex. 6 | VDF-TFE-PMVE | Copolymerization type of polysiloxane-type surface-active agent | 50 | Island phase of 0.8 μm | 30 | A |
| Ex. 7 | VDF-TFE-PMVE | Copolymerization type of polysiloxane-type surface-active agent | 50 | Island phase of 0.8 μm | 30 | A |
| Ex. 8 | VDF-TFE-PMVE | Copolymerization type of polysiloxane-type surface-active agent | 50 | Island phase of 0.8 μm | 30 | A |

Type of fluororubber polymer
VDF: Vinylidenefluoride,
HFP: Hexafluoropropylene
TFE: Tetrafluoroethylene,
PMVE: Perfluoromethyl vinyl ether While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-220624, filed Jul. 29, 2005, which is hereby incorporated by reference herein in its entirety.

What is claimed is:

1. A fixing member used in an electrophotographic image forming apparatus, comprising a toner releasing layer formed on its surface, wherein the toner releasing layer contains as a main component a fluororubber having an ether linkage in its molecule, and further, contains a polysiloxane-type surface-active agent having a dimethylpolysiloxane structure and a polyoxyalkylene structure, wherein the toner releasing layer has a sea-island structure comprising a sea phase constituted of the fluororubber, and island phases consisting of the polysiloxane-type surface-active agent, and wherein a number-based average size of the island phases is 2 μm or less, and wherein the polysiloxane-type surface-active agent is represented by the following formula:

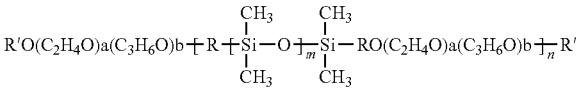

where a and b each denotes 0 or an integer, n and m each denotes an integer, and R and R' each denotes a saturated hydrocarbon or an unsaturated hydrocarbon.

2. The fixing member according to claim 1, wherein the fluororubber is a terpolymer of vinylidene fluoride, tetrafluoroethylene and perfluoromethyl vinyl ether.

3. The fixing member according to claim 1, wherein a blending quantity of the polysiloxane-type surface-active agent is 20 to 60 parts by mass with respect to 100 parts by mass of the fluororubber.

4. The fixing member according to claim 1, which is used as a fixing belt that is a single-layer fixing belt in which the toner releasing layer has been formed on an outer peripheral surface of a base material of the fixing belt, and a thickness of the toner releasing layer is 60 to 150 μm.

* * * * *